US008070527B1

(12) United States Patent
Lee et al.

(10) Patent No.: US 8,070,527 B1
(45) Date of Patent: Dec. 6, 2011

(54) ELECTRICAL CONNECTOR PROVIDED WITH A PIERCER PORTION AND A CLAMPING STRUCTURE

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 12/854,998

(22) Filed: Aug. 12, 2010

(30) Foreign Application Priority Data

Jul. 28, 2010 (TW) ..... 99214366 U

(51) Int. Cl.
*H01R 24/00* (2006.01)

(52) U.S. Cl. ..... 439/660; 439/418; 439/404

(58) Field of Classification Search ..... 439/660, 439/418, 404
See application file for complete search history.

(56) References Cited

U.S. PATENT DOCUMENTS

| | | | | |
|---|---|---|---|---|
| 7,261,585 | B2 * | 8/2007 | Yamanashi et al. | 439/404 |
| 2001/0004565 | A1 * | 6/2001 | Maeda | 439/404 |
| 2005/0186850 | A1 * | 8/2005 | Tsai | 439/660 |
| 2007/0066121 | A1 * | 3/2007 | Arlitt et al. | 439/404 |
| 2009/0117774 | A1 * | 5/2009 | Legrady et al. | 439/449 |

* cited by examiner

*Primary Examiner* — Hien Vu
(74) *Attorney, Agent, or Firm* — Rosenberg, Klein & Lee

(57) ABSTRACT

An electrical connector includes a limiting member having upper and lower sides and a piercer hole formed therethrough; two spaced-apart clamping structures formed on the upper side of the limiting member in parallel manner and sandwiching the piercer hole therebetween, each clamping structure including a protrusion projecting upward from the upper side and having a top portion, a cross-section width gradually larger toward the top portion and a recess adjacent to the protrusion; and a terminal disposed on the lower side of the limiting member, and having a piercing section extending into the piercer hole to pierce through a cable material so as to be exposed from the upper side of the limiting member. A gap defined by an adjacent pair of the protrusions is smaller than an adjacent pair of the recesses in order for clamping the cable material.

5 Claims, 6 Drawing Sheets

ELECTRICAL CONNECTOR PROVIDED WITH A PIERCER PORTION AND A CLAMPING STRUCTURE

This application claims the benefits of the Taiwan Patent Application Serial NO. 099214366 filed on Jul. 28, 2010, the subject matter of which is incorporated herein by reference.

BACKGROUND OF THE INVENTION

1. Field of the Invention

The present invention relates to an electrical connector, more particularly to an electrical connector including a clamping structure for clamping the cable material and a piercer portion for piercing through the cable material precisely.

2. Description of the Prior Art

A cable of a conventional electrical connector generally includes a cable material enclosing sealingly a transmission terminal, which is used for transmitting a signal therethrough. In the prior art, the transmission terminal and the cable material connected to each other via the soldering or welding process. However, the more the numbers of the transmission terminals become, the more the expense and time of soldering or welding process is resulted.

In order to eliminate or at least improve the aforesaid problems, each transmission terminal of late is formed with a piercer portion, that can pierce through the cable material of an insulated sheath and that can simultaneously and electrically connected to a conduction wire within the cable material. Since majority of the terminals in the conventional electrical connector are arranged densely located in parallel manner so that the piercer portions also extend in the same direction as the terminals. Thus, the cross-section of each piercer portion is smaller than or equivalent to the cross-section of each terminal. However, most of the cable materials are circular in cross section, in case the piercer portion of the terminal is unable to pierce through the cable material precisely and deviates accidentally from the precise location during the piercing operation, there may result in poor electrical connection between the terminal and the conduction wire within the cable sheath, thereby rendering in poor quality of the conventional electrical connector.

SUMMARY OF THE INVENTION

In order to eliminate or improve the aforesaid drawbacks, the object of the present invention is to provide an electrical connector having a terminal with a piercing section and a clamping structure for clamping a cable material of a cable sheath. Since the piercing section of the terminal can precisely pierce through the cable material, the electrical connection between the terminal and a conduction wire enclosed within the cable sheath is enhanced, thereby time saving during assembly and increasing the quality of the electrical connector of the present invention.

The electrical connector according to the present invention includes a limiting member, a pair of spaced apart clamping structures and at least one terminal. The limiting member has an upper side, a lower side and a piercer hole formed through the upper and lower sides. The clamping structures are formed on the upper side of the limiting member in parallel manner to sandwich the piercer hole therebetween. Each clamping structure includes a protrusion projecting upward from the upper side and having a top portion, a cross-section width gradually larger toward the top portion and a recess adjacent to the protrusion. The terminal is disposed on the lower side of the limiting member, has a piercing section extending into the piercer hole to pierce through a cable material so as to be exposed from the upper side of the limiting member. Note that a gap defined by an adjacent pair of the protrusions of the clamping structures is smaller than an adjacent pair of the recesses of the clamping structures in order for clamping the cable material.

As described above, in the electrical connector of the present invention, the piercing section of the terminal can pierce through the cable material during the assembly, which is time saving and easier when compared to the prior art soldering process for connecting the terminals. In addition, the presence of clamping structures in the present electrical connector enhance securely clamping of the cable material during the assembly, which, in turn, facilitate and enhance precise connection between the conduction wire within the cable sheath and the terminal. Thus, the quality of the electrical connector of the present invention is increased.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
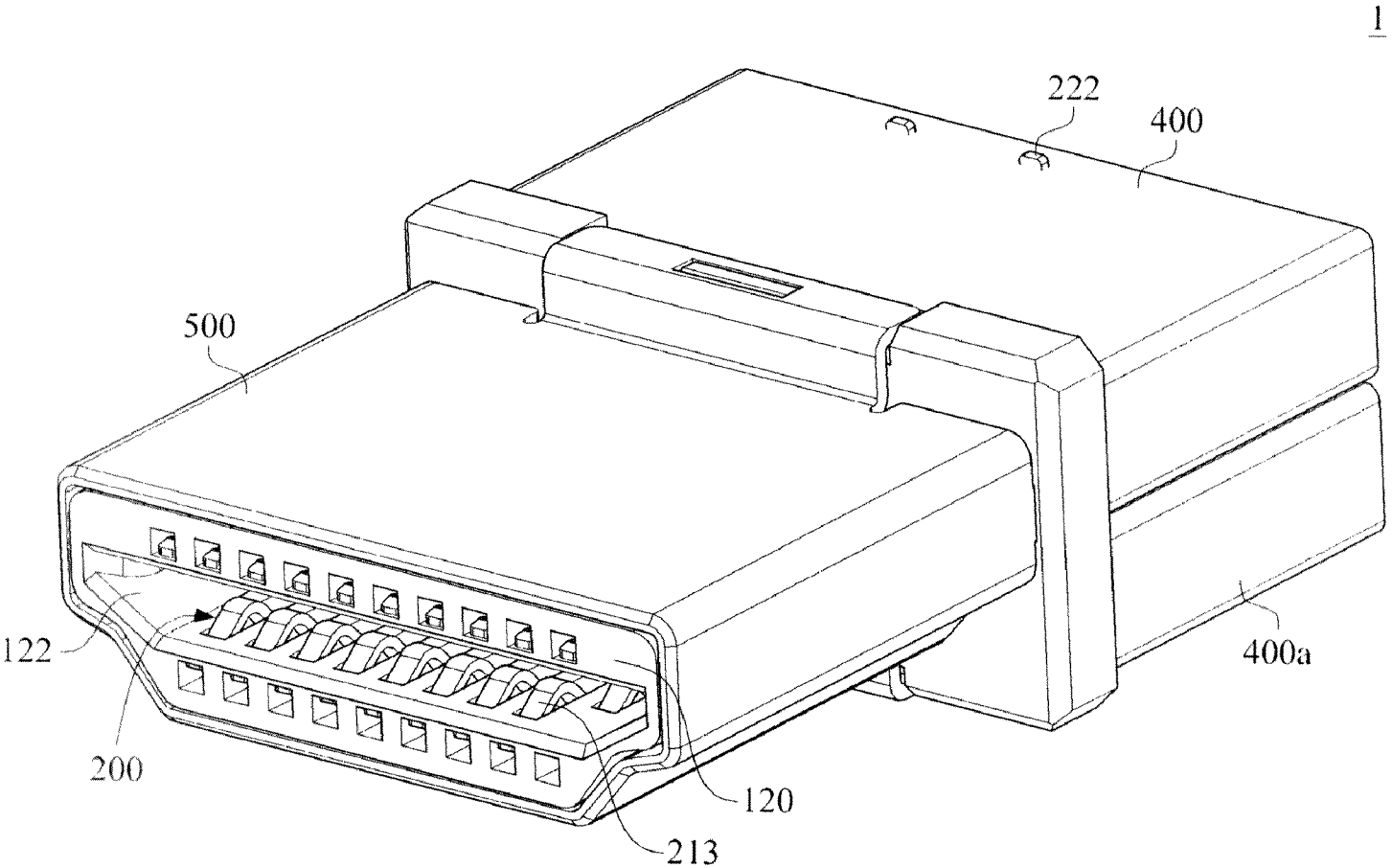
FIG. 1 shows a perspective view of an electrical connector of the present invention having a terminal with a piercer portion a and a clamping structure.
Figure 2:
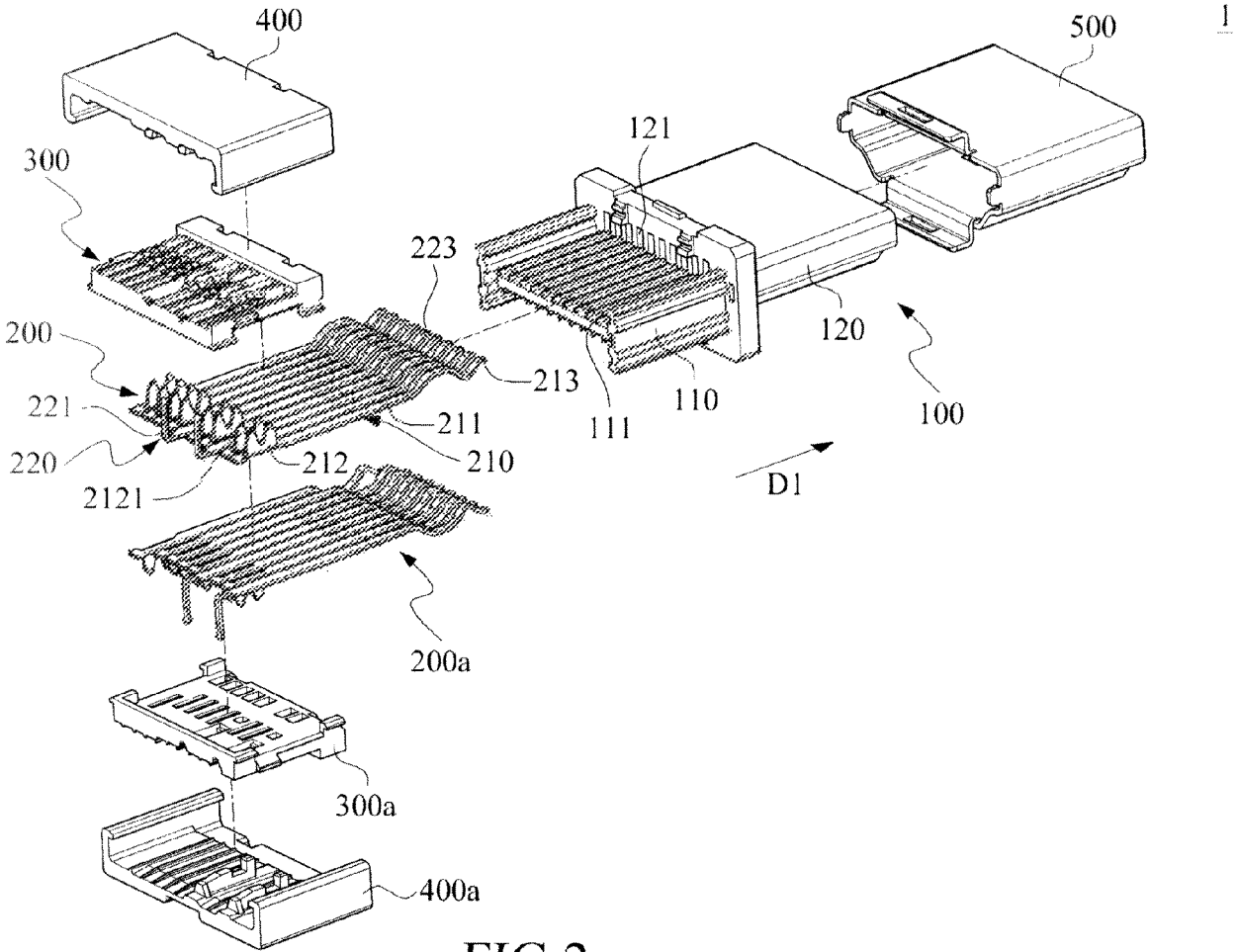
FIG. 2 shows a perspective and exploded view of the electrical connector of the present invention.

Referring to FIGS. 1 and 2, wherein FIG. 1 shows a perspective view of an electrical connector of the present invention having a terminal with piercer portion and a clamping structure while FIG. 2 shows a perspective and exploded view of the electrical connector of the present invention. As illustrated, the electrical connector 1 of the present invention includes an insulated body 100, a plurality of first terminals 200, a first limiting member 300, a first cover member 400 and a metal casing 500. In addition, the electrical connector 1 of the present invention further includes a plurality of second terminals 200*a*, a second limiting member 300*a* and a second cover member 400*a*. In this preferred embodiment, the first terminals 200, the first limiting member 300 and the first cover member 400 are assembled at the rear side of the insulated body 100 while the second terminals 200*a*, the second limiting member 300*a* and the second cover member 400*a* are assembled at the front side of the insulated body 100 opposite to the rear side thereof. Preferably, the second terminals 200*a*, the second limiting member 300*a* and the second cover member 400*a* may have the same or similar structures to those of the first terminals 200, the first limiting member 300 and the first cover member 400; however the limitation should not be limited thereto.

As illustrated, the insulated body 100 has a holding portion 110 and a tongue portion 120. The holding portion 110 is formed a plurality of terminal reception grooves 111 extending along the D1 direction for receiving the first terminals 200 respectively. The tongue portion 120 extends frontward from the holding portion 110 and, has a distal portion formed with a plurality of fixing holes 121 at one side thereof along the D1 direction and an insert chamber 122 at the other side in spatial communication with each of the fixing holes 121. Moreover, the terminal reception grooves 111 are in spatial communication with the fixing holes 121 respectively such that the first terminals 200 extend respectively through the fixing holes 121 so as to be exposed partially from the insert chamber 122 (see FIG. 1).

The first terminals 200 preferably includes a plurality of conduction terminals 210 and a plurality of ground-contact terminals 220. The conduction terminals 210 are used for transmission of signals while the terminals 220 are connected to the earth for grounding purpose.

Each of the conduction terminals 210 has a connection section 211 extending along the D1 direction and received within a respective terminal reception groove 111 in the holding portion 110, a contact section 213 extending through a respective fixing hole 121 so as to be exposed from the insert chamber 122 and a piercing section 212 extending from the connection section 211 perpendicularly with respect to the D1 direction. Each piercing section 212 is provided with a pair of sharp tips 2121, which are adapted to pierce through the cable material (A) of the insulated sheath A1 (see FIG. 6) so as to electrically connect the conduction terminal 210 with a conduction wire A2 (see FIG. 6) within the insulated sheath A1.

Each ground-contact terminal 220 has a ground section 222, a contact section 223 and a connection section 221 extending along the D1 direction and interconnecting the ground section 222 and the contact section 223. The connection section 221 is received within a respective terminal reception groove 111 while the contact section 223 extends through a respective fixing hole 121 so as to be exposed from the insert chamber 122 in the tongue portion 120. The ground section 222 extends from the connection section 221 perpendicularly with respect to the D1 direction and is formed as a hook configuration for engaging the cover member 400 securely.

Figure 3:
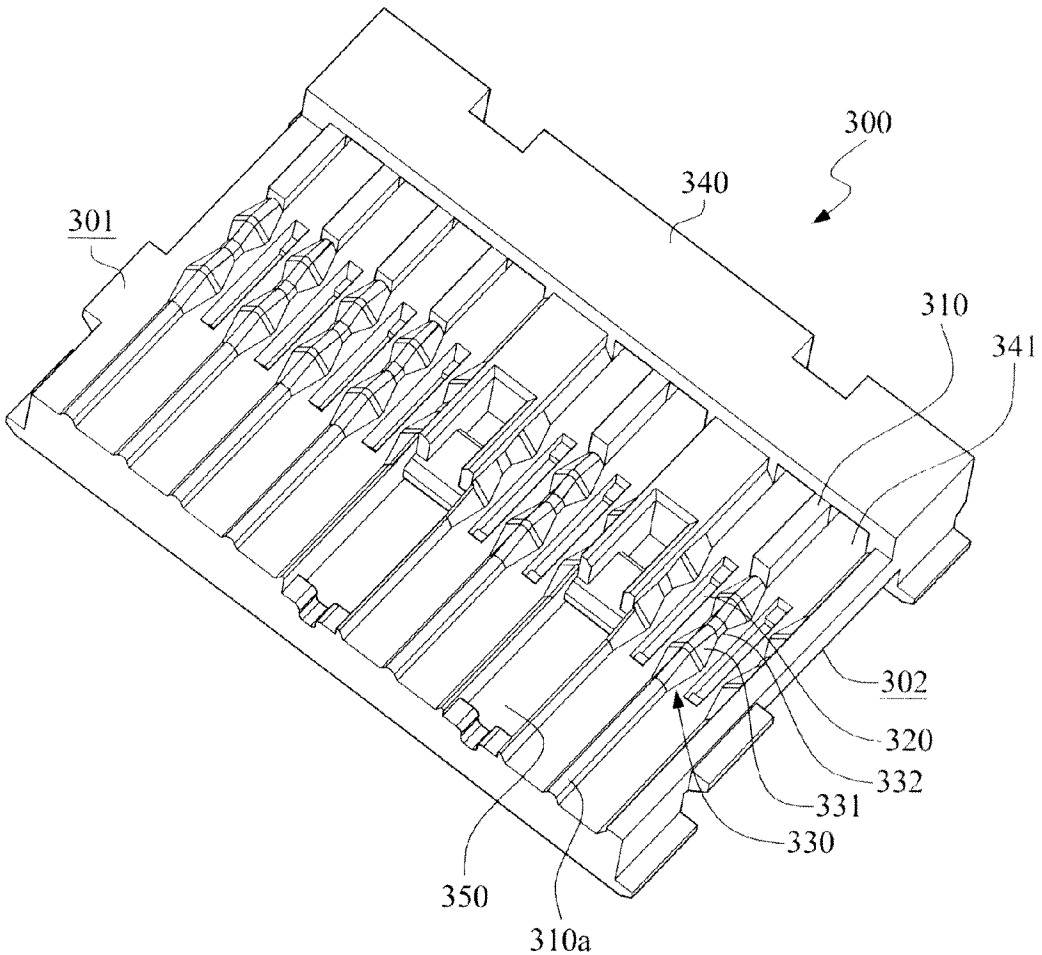
FIG. 3 is a perspective view of a limiting member employed in the electrical connector of the present invention.
Figure 5:
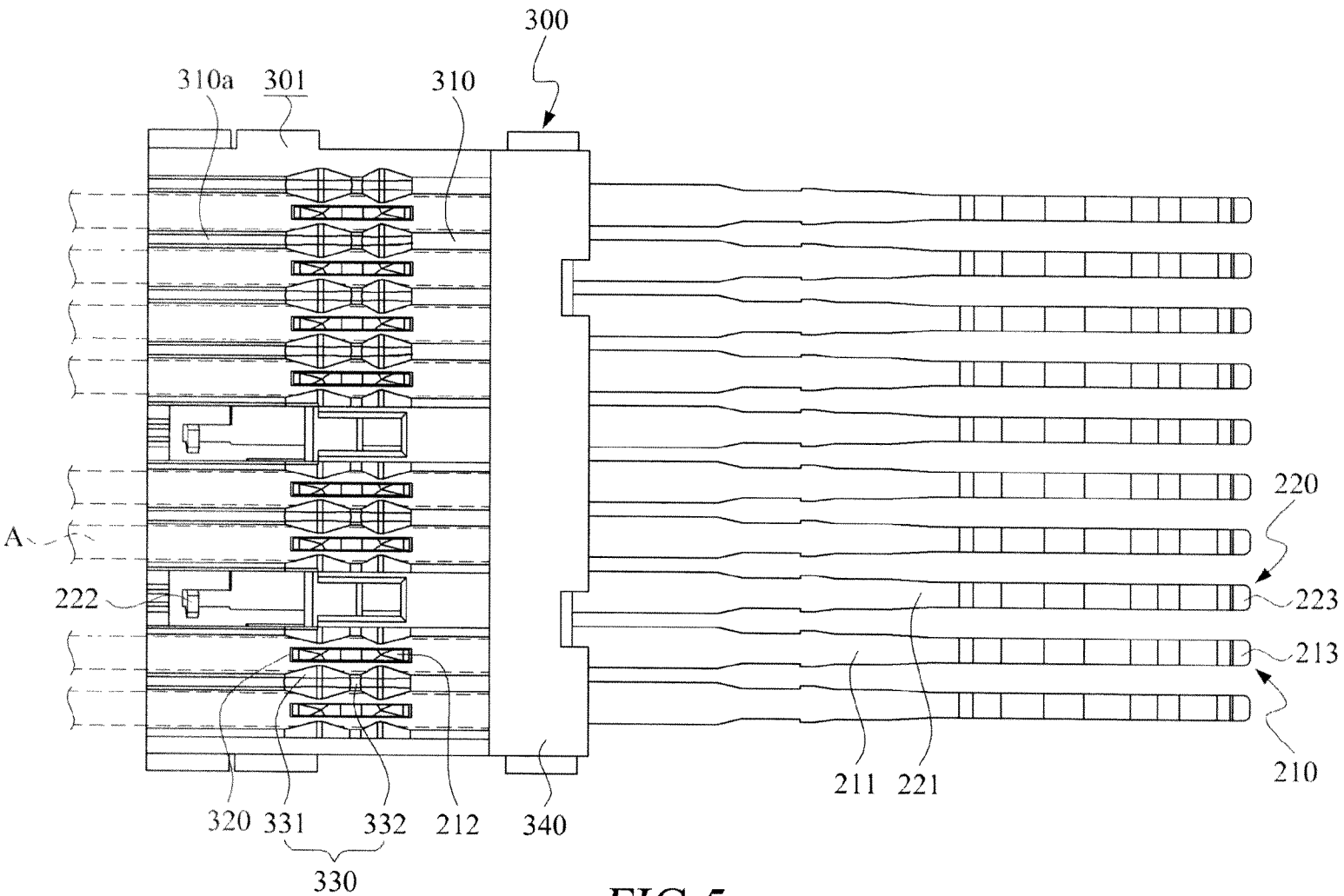
FIG. 5 shows a fragmentary top view illustrating how a cable material enclosing the terminal therein and how the cable material is clamped by the clamping structure of the electrical connector of the present invention while the cable material is pierced through by the piercer portion of the terminal.

FIG. 3 shows the perspective view of the first limiting member 300 employed in the electrical connector 1 of the present invention. As shown, the first limiting member 300 is mounted onto the holding portion 110 of the insulated body 100, and has an upper side 301 and a lower side 302. The first limiting member 300 further has a plurality of spacers 310, 310*a*, a plurality of clamping structures 330 and a plurality of piercer holes 320, a limiting structure 340 and a plurality of ground holes 350. The spacers 310, 310*a* are spaced apart from one another, are formed on the upper side 301 in parallel manner and extend in the D1 direction. As best shown in FIG. 5, several pieces of cable materials A are disposed on the first limiting member 300 such that an adjacent pair of the spacers 310 is spaced apart by the respective cable material (A).

Each piercer hole 320 and the ground hole 350 extend through the upper and lower sides of the limiting member 300. Each piercer hole 320 is sandwiched between an adjacent pair of the clamping structures 330 or an adjacent pair of the spacers 310. In other words, two clamping structures 330 are at two opposite sides of the piercer hole 320. Note that each clamping structure 330 is integrally connected to a respective spacer 310, 310*a* along the D1 direction.

Each clamping structure 300 preferably includes a pair of protrusions 331 and a recess 332 therebetween. Since a gap defined by an adjacent pair of the protrusions 331 is smaller than or equivalent to an adjacent pair of the recesses 332, the respective cable material (A) is clamped between the adjacent pair of the protrusions 331 of an adjacent pair of the clamping structures 330. Since the cable material (A) being a part of an elastic and insulated sheath A1 (see FIG. 6) enclosing the conduction wire A2 (see FIG. 6), regardless of the width of the cable material (A) is slightly larger, smaller or equivalent to the gap defined between the adjacent pair of the recesses 332 or the protrusions 331, the cable material (A) is clamped resiliently and easily between the adjacent pair of the clamping structures 330, which, in turn, prevents the undesired error caused due to failing to clamp the cable material (A) securely and tightly during the manufacturing process of the electrical connector of the present invention. Thus, the cable material (A) is prevented disengaging from an adjacent pair of the spacers 310 or is clamped resiliently between an adjacent pair of the clamping structures 330.

In addition, each protrusion 331 has a cross-section width the largest at the top portion and gradually smaller toward a lower portion in order to enhance or facilitate clamping of the cable material (A) between an adjacent pair of the clamping structures 330.

The limiting structure 340 is attached to one end (the front end) of the limiting member 300 to define a cable reception chamber 341, which is in spatial communication with a channel defined by an adjacent pair of the spacers 310. One distal portion of the cable material (A) is terminating within the cable reception chamber 341, which further prevents disengaging of the cable material (A) from an adjacent pair of the spacers 310 or an adjacent pair of the clamping structures 330.

The ground section 222 of each ground-contact terminal 220 extends through a respective ground hole 350 to engage the cover member 400 after assembly.

The cover member 400 is preferably made from metal or plastic materials, and is mounted over the holding portion 110 of the insulated body 100 so as to cover the limiting member 300 from above. Hence the first terminals 200 and the limiting member 300 are enclosed between the cover member 400 and the holding portion 110. The metal casing 500 is sleeved over the tongue portion 120 of the insulated body 100 in such a manner to mate with the cover members 400, 400*a*.

Figure 4:
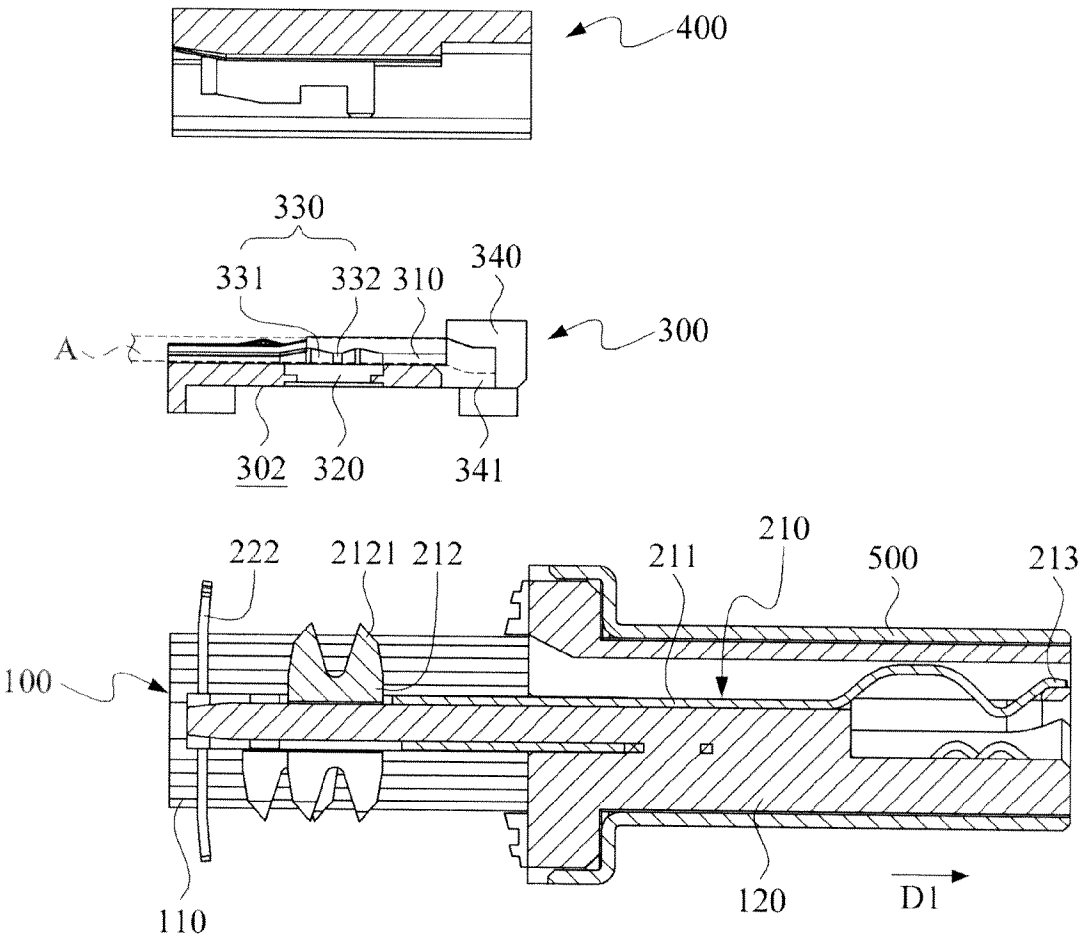
FIG. 4 illustrates a cross-section view the elements of the electrical connector of the present invention during assembly.
Figure 6:
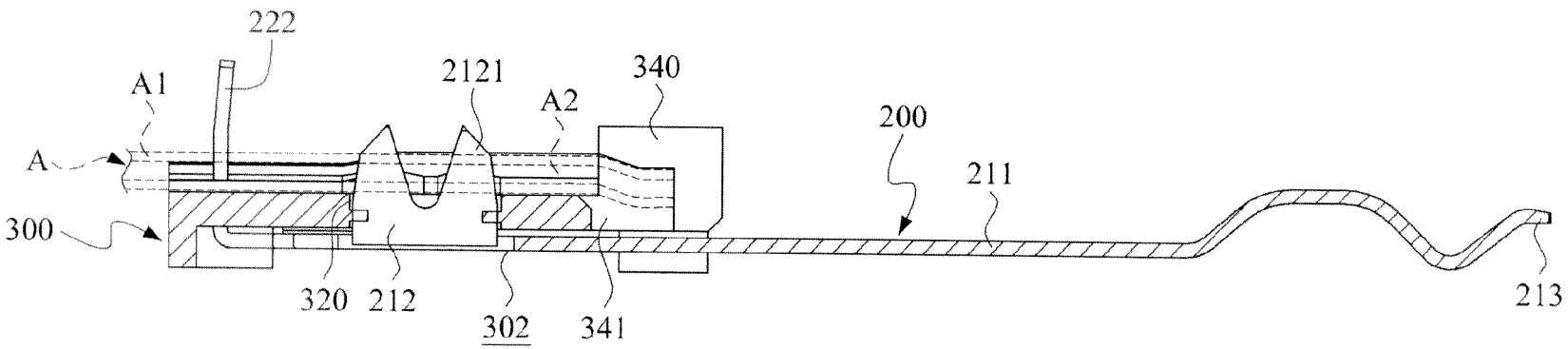
FIG. 6 is a fragmentary cross-section view illustrating how the cable material enclosing the terminal in the electrical connector of the present invention is pierced through during the assembly by the piercer portion of the terminal.

FIG. 4 illustrates a cross-section view the elements of the electrical connector 1 of the present invention during assembly. During assembling of the electrical connector 1, the terminals 200 are mounted on the insulated body 100 firstly so as to clamp the cable material (A) between adjacent pair of the clamping structures 330 such that distal portions of the cable materials (A) are terminating in the cable reception chamber 341. Then, the limiting member 300, on which the adjacent pair of the clamping structures 330 clamps a cable material (A), is disposed over the holding portion 110 such that depression of the limiting member 300 relative to the holding portion 110 results in piercing the piercing sections 212 of the conduction terminals 210 through the piercer hole 320 so as to expose the piercing section 212 above the upper side 301 of the limiting member 300. At the same time, the ground section 222 of each ground-contact terminal 220 extends through a respective ground hole 350 (see FIG. 5). Thus, as illustrated in FIGS. 5 and 6, depression of the cover member 400 over the holding portion 110 of the insulated body 100 results in compressing the cable material (A) underneath.

At this time, since the cable material (A) is clamped between adjacent pair of the clamping structures 330 and since the conduction wire A2 of the cable sheath A1 is aligned with the piercer hole 320 with the piercing sections 212 of the conduction terminals 210 through the piercer hole 320, the conduction wire A2 is connected electrically and easily to the respective conduction terminal 210. In addition, the ground section 222 of each ground-contact terminal 220 is engaged with the cover member 400, thereby completing the assembly of the electrical connector 1 of the present invention.

As described above, in the electrical connector of the present invention, the piercing section 212 of the terminal 210 pierce through the cable material during the assembly, which is time saving and easier when compared to the prior art soldering process for connecting the terminals. In addition, the presence of clamping structures 330 in the present electrical connector 1 enhance securely clamping of the cable material during the assembly, which, in turn, facilitate and enhance precise connection between the conduction wire A2 within the cable sheath A1 and the terminal 210. Thus, the quality of the electrical connector of the present invention is increased.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector comprising:

a limiting member having an upper side to receive a cable, a bottom side opposite said upper side and a piercer hole formed through said upper and bottom sides;

a pair of spaced apart clamping structures formed on said upper side of said limiting member in parallel manner and sandwiching said piercer hole therebetween, each clamping structure including protrusions projecting upwardly from said upper side and having a top portion, a cross-section width gradually larger toward said top portion and a recess in between said protrusions;

a terminal disposed on said bottom side of said limiting member, having a piercing section extending into said piercer hole to pierce through a material of the cable so as to be exposed from said upper side of said limiting member; and a cover member substantially entirely covering said limiting member such that downward depression of said cover member over said limiting member during assembly results in piercing said piercer section of said terminal through said cable material so as to expose said piercer section from said upper side of said limiting member;

wherein, a gap defined by an adjacent pair of said protrusions of said clamping structures is smaller than an adjacent pair of said recesses of said clamping structures in order for clamping said cable material.

2. The electrical connector assembly according to claim 1, further comprising a limiting structure attached to one end of said limiting member, said limiting structure defining a cable reception chamber such that one distal portion of said cable material is terminating within said cable reception chamber.

3. The electrical connector according to claim 1, wherein each clamping structure includes a pair of said protrusions sandwiching said recess therebetween.

4. The electrical connector according to claim 1, further comprising an insulated body having a holding portion and a tongue portion that extends from said holding portion and that is formed with an insert chamber, wherein said terminal is disposed securely on said holding portion, and has the other distal portion extending through said tongue portion so as to expose from said insert chamber.

5. The electrical connector according to claim 4, wherein said bottom side of said limiting member is mounted on said holding portion of said insulated body.

* * * * *